US007063148B2

(12) United States Patent
Jabusch

(10) Patent No.: US 7,063,148 B2
(45) Date of Patent: Jun. 20, 2006

(54) METHOD AND SYSTEM FOR TRANSMITTING SIGNALS THROUGH A METAL TUBULAR

(75) Inventor: Kirby D. Jabusch, Edmonton (CA)

(73) Assignee: Marathon Oil Company, Houston, TX (US)

( * ) Notice: Subject to any disclaimer, the term of this patent is extended or adjusted under 35 U.S.C. 154(b) by 89 days.

(21) Appl. No.: 10/726,027

(22) Filed: Dec. 1, 2003

(65) Prior Publication Data

US 2005/0115708 A1 Jun. 2, 2005

(51) Int. Cl.
*E21B 47/12* (2006.01)

(52) U.S. Cl. ..... 166/250.15; 166/66.5; 166/250.01; 166/250.11

(58) Field of Classification Search ..... 166/55.2, 166/66.5, 66.6, 250.01, 250.11, 250.15, 250.17, 166/254.2, 298, 369, 373
See application file for complete search history.

(56) References Cited

U.S. PATENT DOCUMENTS

| | | | | |
|---|---|---|---|---|
| 3,684,008 | A | 8/1972 | Garrett | |
| 4,023,167 | A | 5/1977 | Wahlstrom | |
| 4,572,293 | A | 2/1986 | Wilson et al. | |
| 4,599,182 | A | 7/1986 | Young et al. | |
| 4,630,044 | A | 12/1986 | Polzer | |
| 4,656,463 | A | 4/1987 | Anders et al. | |
| 4,698,631 | A | 10/1987 | Kelly, Jr. et al. | |
| 4,808,925 | A | 2/1989 | Baird | |
| 4,827,395 | A | 5/1989 | Anders et al. | |
| 5,105,742 | A | 4/1992 | Sumner | |
| 5,142,128 | A | 8/1992 | Perkin et al. | |
| 5,191,936 | A | 3/1993 | Edwards et al. | |
| 5,202,680 | A | 4/1993 | Savage | |
| 5,230,387 | A * | 7/1993 | Waters et al. | 175/45 |
| 5,279,366 | A | 1/1994 | Scholes | |
| 5,355,957 | A | 10/1994 | Burleson et al. | |
| 5,361,838 | A | 11/1994 | Kilgore | |
| 5,457,447 | A | 10/1995 | Ghaem et al. | |
| 5,467,083 | A * | 11/1995 | McDonald et al. | 340/854.6 |
| 5,479,860 | A | 1/1996 | Ellis | |
| 5,495,237 | A | 2/1996 | Yuasa et al. | |
| 5,497,140 | A | 3/1996 | Tuttle | |
| 5,505,134 | A | 4/1996 | Brooks et al. | |
| 5,608,199 | A | 3/1997 | Clouse, III et al. | |
| 5,626,192 | A | 5/1997 | Connell et al. | |
| 5,654,693 | A | 8/1997 | Cocita | |
| 5,660,232 | A | 8/1997 | Reinhardt | |

(Continued)

FOREIGN PATENT DOCUMENTS

| | | |
|---|---|---|
| EP | 0 013 494 A1 | 7/1980 |

(Continued)

*Primary Examiner*—Zakiya W. Bates
(74) *Attorney, Agent, or Firm*—Jack E. Ebel; Rodney F. Brown

(57) ABSTRACT

A method for transmitting signals through a metal tubular includes the steps of transmitting modulated electromagnetic signals through a non magnetic metal section of the metal tubular, detecting the signals or a field associated with the signals, and controlling or monitoring devices or operations associated with the metal tubular responsive to the signals. A material, geometry, treatment, and alloying of the non magnetic metal section are selected to optimize signal transmission therethrough. A system for performing the method includes the metal tubular and the non magnetic metal section. The system can also include a transmitter device configured to move through the metal tubular emitting the electromagnetic signals, an antenna on the outside of the non magnetic metal section configured to detect the electromagnetic signals, and a receiver-control circuit configured to generate control signals responsive to the electromagnetic signals.

64 Claims, 10 Drawing Sheets

U.S. PATENT DOCUMENTS

| | | | |
|---|---|---|---|
| 5,680,459 | A | 10/1997 | Hook et al. |
| 5,682,143 | A | 10/1997 | Brady et al. |
| 5,720,345 | A | 2/1998 | Price et al. |
| 5,829,538 | A | 11/1998 | Wesson et al. |
| 5,911,277 | A | 6/1999 | Hromas et al. |
| 5,995,449 | A | 11/1999 | Green et al. |
| 6,018,501 | A | 1/2000 | Smith et al. |
| 6,025,780 | A | 2/2000 | Bowers et al. |
| 6,078,259 | A | 6/2000 | Brady et al. |
| 6,135,206 | A | 10/2000 | Gano et al. |
| 6,151,961 | A | 11/2000 | Huber et al. |
| 6,257,338 | B1 | 7/2001 | Kilgore |
| 6,333,699 | B1 | 12/2001 | Zierolf |
| 6,333,700 | B1 | 12/2001 | Thomeer et al. |
| 6,426,917 | B1 | 7/2002 | Tabanou et al. |
| 6,450,258 | B1 | 9/2002 | Green et al. |
| 6,536,524 | B1 | 3/2003 | Snider |
| 6,577,244 | B1 | 6/2003 | Clark et al. |
| 2001/0013410 | A1 | 8/2001 | Beck et al. |
| 2001/0013411 | A1 | 8/2001 | Beck et al. |
| 2001/0042617 | A1 | 11/2001 | Beck et al. |
| 2001/0043146 | A1 | 11/2001 | Beck et al. |
| 2001/0054969 | A1 | 12/2001 | Thomeer et al. |

FOREIGN PATENT DOCUMENTS

| | | |
|---|---|---|
| EP | 0 412 535 B1 | 5/1994 |
| EP | 0 651 132 B1 | 5/1995 |
| EP | 0 730 083 A2 | 4/1996 |
| FR | 1.033.631 | 7/1953 |
| SU | 1657627 A1 | 6/1991 |
| WO | WO 01/18357 A2 | 3/2001 |
| WO | WO 01/73423 A1 | 10/2001 |

* cited by examiner

METHOD AND SYSTEM FOR TRANSMITTING SIGNALS THROUGH A METAL TUBULAR

FIELD OF THE INVENTION

This invention relates generally to signal transmission in metal tubulars, and specifically to a method and a system for transmitting signals through metal tubulars, such as tubulars used in the production of fluids from subterranean wells.

BACKGROUND OF THE INVENTION

Various downhole operations are performed during the drilling and completion of a subterranean well, and also during the production of fluids from subterranean formations via the completed well. Representative downhole operations include perforating well casings, installing well devices, controlling well devices, and monitoring well parameters and output. Although downhole operations are performed at some depth within the well, they are typically controlled at the surface. For example, signal transmission conduits, such as electric cables and hydraulic lines, can be used to transfer signals from a depth within the well to a control system at the surface. Components of the control system then process the signals for controlling the downhole operations.

A recently developed method for controlling downhole operations employs devices within the well, which are configured to transmit and receive electromagnetic signals, such as radio frequency (RF) signals. These signals can then be used to control a tool or other device in the well, without the need to transmit and process the signals at the surface.

U.S. Pat. No. 6,333,691 B1 to Zierolf, entitled "Method And Apparatus For Determining Position In A Pipe", and U.S. Pat. No. 6,536,524 B1 to Snider, entitled "Method And System For Performing A Casing Conveyed Perforating Process And Other Operations In Wells", disclose representative systems which use electromagnetic transmitting and receiving devices. These devices are sometimes referred to as radio frequency identification devices (RFID). Typically, systems employing radio frequency devices require the radio frequency signals to be transmitted from the inside to the outside of the metal tubulars used in the well. In the past this has required penetrating structures such as sealed openings or windows in the metal tubulars. In general, these penetrating structures are expensive to make, and compromise the structural integrity of the tubulars.

Referring to FIGS. 1A and 1B, one such prior art system 10 for performing a perforating process in a well 12 using radio frequency signals is illustrated. The well 12 includes a well bore 16, and a well casing 14 within the well bore 16 surrounded by concrete 18. The well 12 extends from an earthen surface (not shown) through geological formations within the earth, which are represented as Zones A, B and C. The well casing 14 comprises a plurality of metal tubulars 20, such as lengths of metal pipe or tubing, attached to one another by collars 22 to form a fluid tight conduit for transmitting fluids.

The system 10 also includes a reader device assembly 24 on the well casing 14; a perforating tool assembly 26 on the well casing 14; a flapper valve assembly 28 on the well casing 14; and an identification device 30 (FIG. 1B) configured for movement through the well casing 14. The reader device assembly 24 includes a reader device collar 32 attached to the well casing 14, and a reader device 34 configured to transmit RF transmission signals at a selected frequency to the identification device 30, and to receive RF response signals from the identification device 30. The reader device 34 also includes a control circuit 38 configured to control the operation of the perforating tool assembly 26 and the flapper valve assembly 28 responsive to signals from the identification device 30.

In this system 10, the reader device collar 32 includes an electrically non-conductive window 36, such as a plastic or a composite material, that allows the RF signals to be freely transmitted between the reader device 34 and the identification device 30. One problem associated with the window 36 is that the strength of the well casing 14 is compromised, as a relatively large opening must be formed in the casing 14 for the window 36. In addition, the window 36 requires a fluid tight seal, which can rupture due to handling, fluid pressures or corrosive agents in the well 12. Further, the collar 32 for the window 36 is expensive to manufacture, and expensive to install on the casing 14.

Another approach to transmitting electromagnetic signals in a metal tubular is to place an antenna for an outside mounted reader device on the inside of the tubular, and then run wires from the antenna to the outside of the tubular. This approach also requires openings and a sealing mechanism for the wires, which can again compromise the structural strength and fluid tight integrity of the tubular.

It would be advantageous to be able to transmit electromagnetic signals between the inside and the outside of a metal tubular without compromising the strength of the tubular, and without penetrating and sealing the tubular. The present invention is directed to a method and a system for transmitting signals through metal tubulars without penetrating and sealing structures. In addition, the present invention is directed to systems for performing and monitoring operations in wells that incorporate metal tubulars. Further, the present invention is directed to a method for improving production in oil and gas wells using the system and the method.

SUMMARY OF THE INVENTION

In accordance with the present invention, a method and a system for transmitting signals through a metal tubular are provided. The method, broadly stated, includes the steps of: transmitting electromagnetic signals through a non magnetic metal section of the tubular; detecting the electromagnetic signals, or fields associated with the electromagnetic signals; and controlling or monitoring a device or operation associated with the metal tubular responsive to the detecting step. The electromagnetic signals can comprise modulated signals, such as radio frequency (rf) signals, electric field signals, electromagnetic field signals or magnetic field signals.

The system includes the metal tubular and the non magnetic metal section on the metal tubular. In an illustrative embodiment, the non magnetic metal section comprises a stainless steel tubular segment having a strength that equals or exceeds that of the metal tubular. In addition, the material, geometry, treatment, and alloying of the non magnetic metal section are selected to optimize signal transmission therethrough. The system can also include an antenna outside of the non magnetic metal section, and a transmitter device inside the metal tubular configured to emit electromagnetic signals for transmission through the non magnetic metal section to the antenna.

The system can also include a receiver-control circuit in electrical communication with the antenna, which is configured to detect, amplify, filter and tune the electromagnetic signals, and to transmit signals in response for controlling devices or operations associated with the metal tubular. The receiver-control circuit can also be configured to achieve bi-directional data transfer to the transmitter device for sensing and monitoring devices or operations. In this case the transmitter device can be configured to transmit data to another location, such as the surface, or to store the data for subsequent retrieval.

With the antenna and the receiver-control circuit located outside of the metal tubular, there is no requirement for windows or non metallic joints, which can compromise the structural integrity of the metal tubular. Further, there is no requirement for sealing mechanisms for antenna wires passed between the inside and the outside of the metal tubular.

DETAILED DESCRIPTION OF THE PREFERRED EMBODIMENT

Figure 1A:
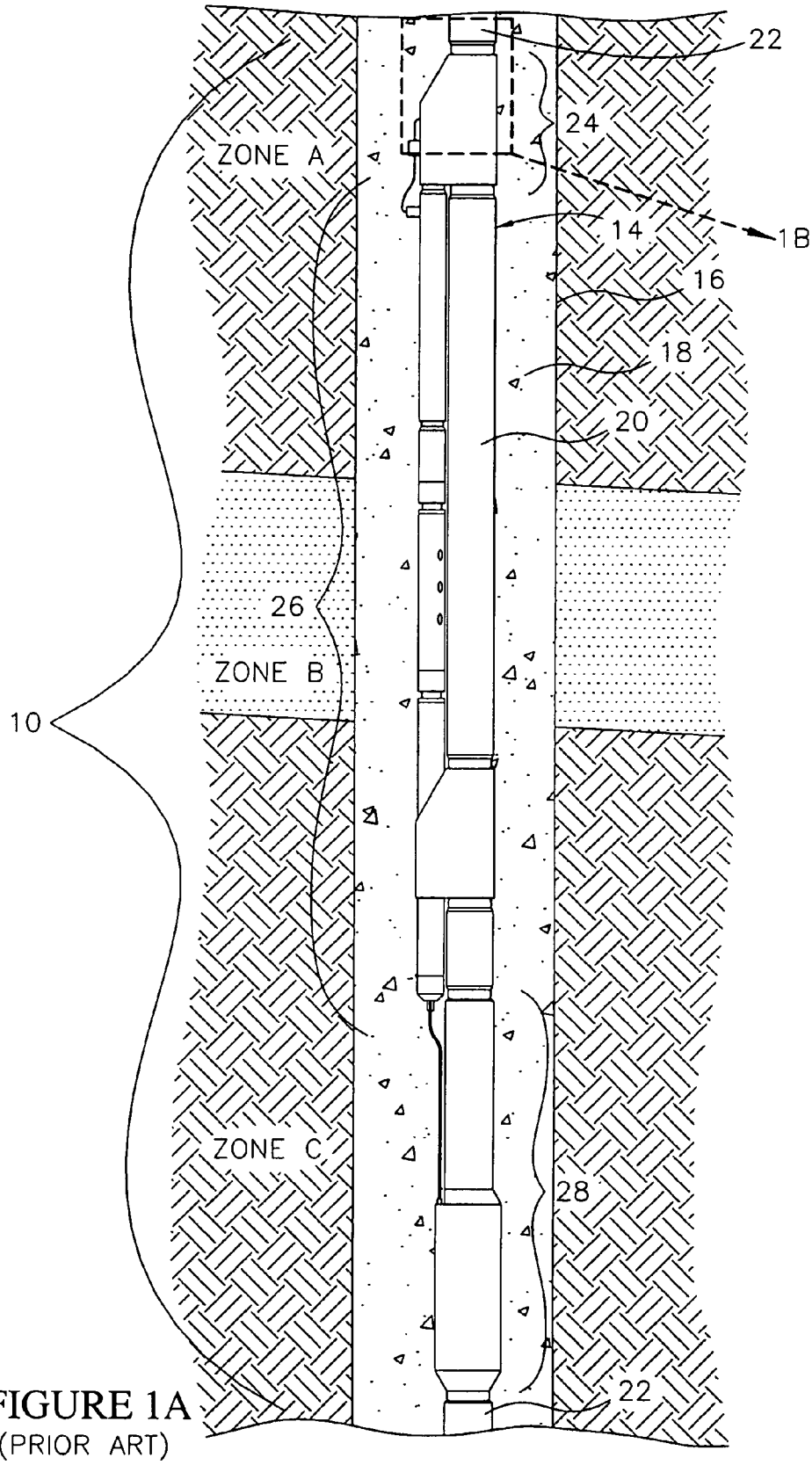
FIGURE 1A (PRIOR ART)
FIG. 1A is a schematic cross sectional view of a prior art perforating system in a subterranean well.
Figure 1B:
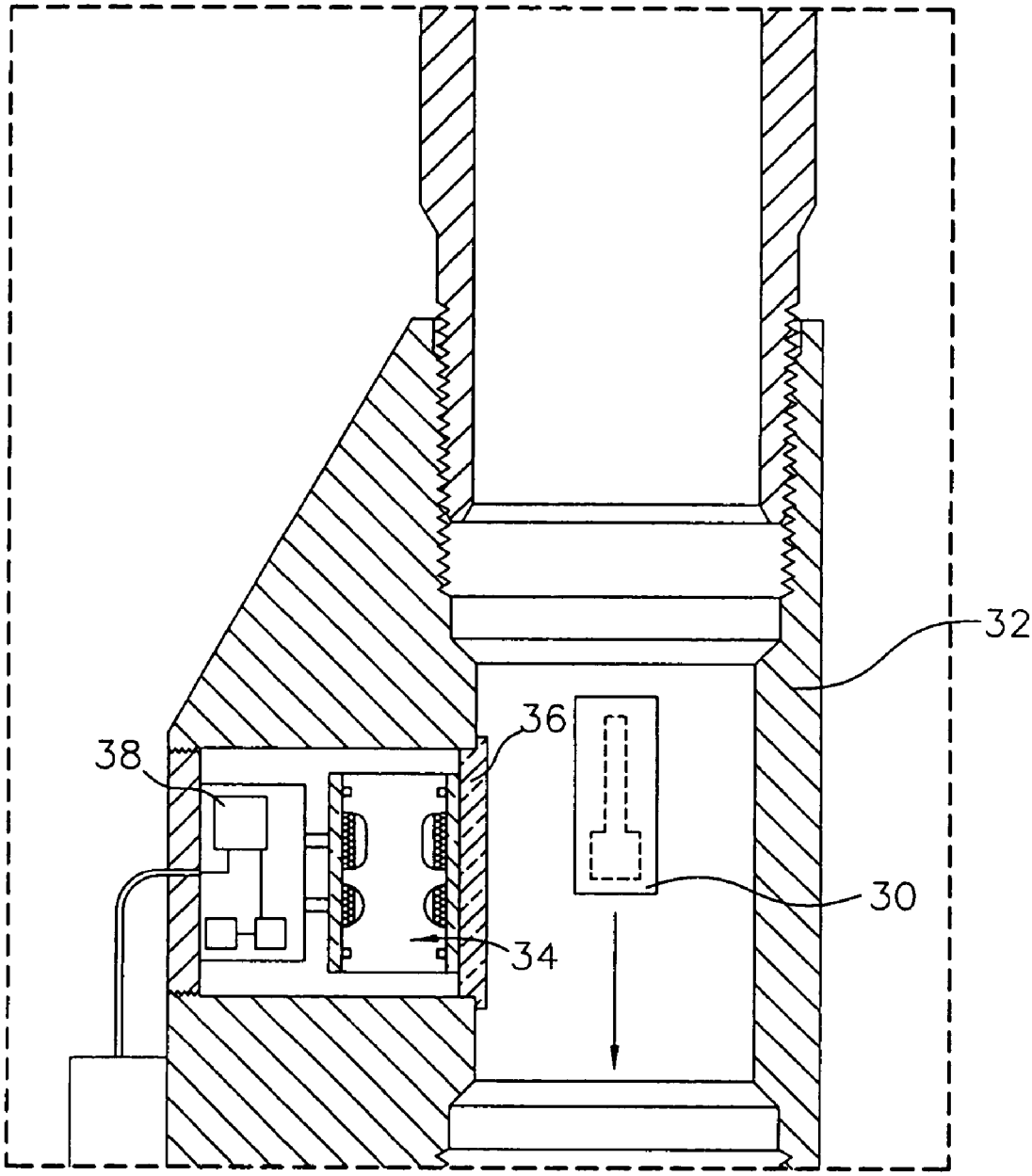
FIGURE 1B (PRIOR ART)
FIG. 1B is an enlarged schematic cross sectional view taken along line 1B of FIG. 1A illustrating a reader device and a transmitter device of the prior art system.
Figure 2:
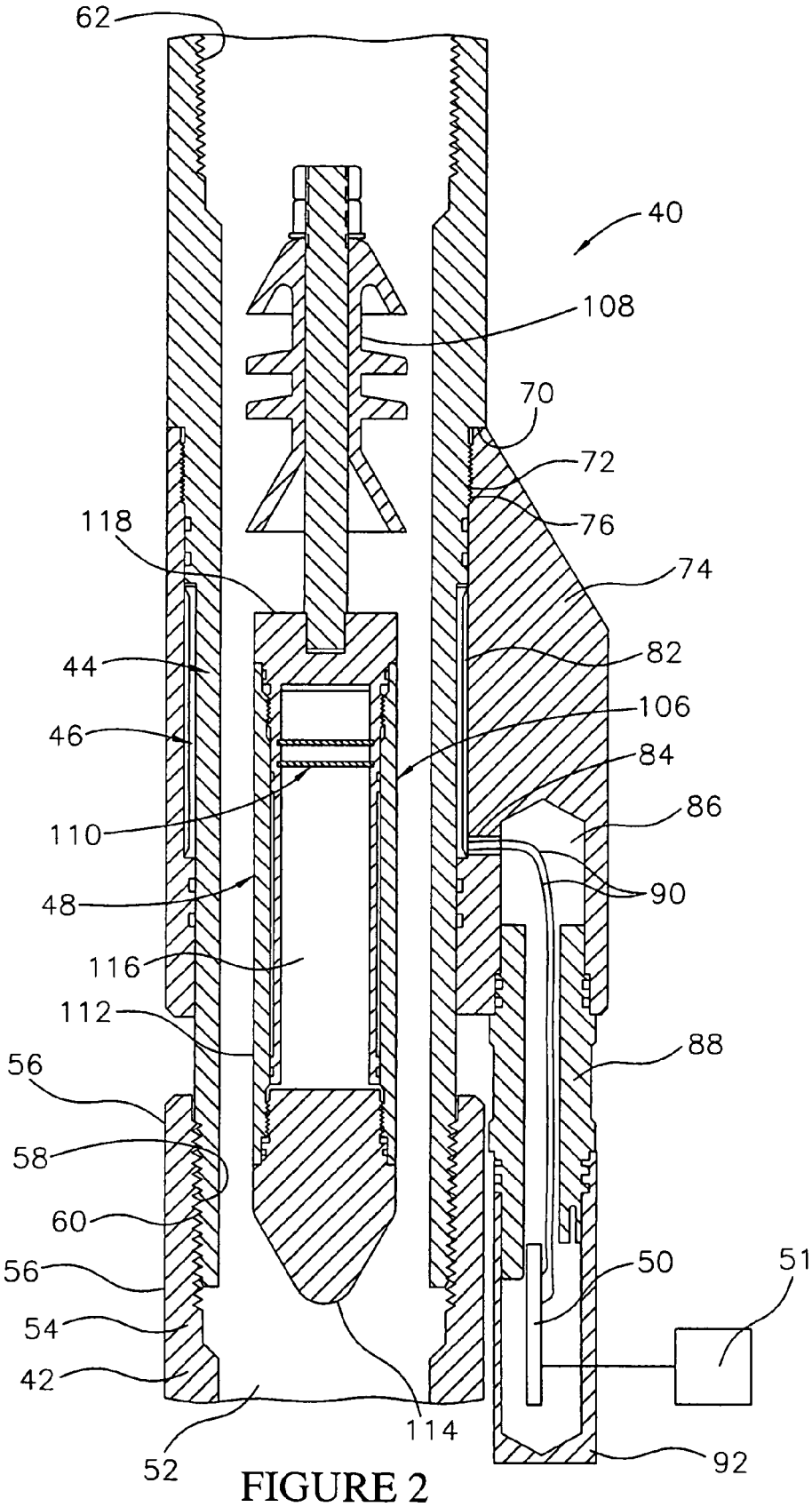
FIG. 2 is a schematic cross sectional view of a signal transmission system constructed in accordance with the invention.

Referring to FIG. 2, a signal transmission system 40 constructed in accordance with the invention is illustrated. The system 40 includes a metal tubular 42, a non magnetic metal section 44 attached to the metal tubular 42, and an antenna 46 on the outside of the non magnetic metal section 44.

The system 40 also includes a transmitter device 48 inside the metal tubular 42 configured to emit electromagnetic signals, and a receiver-control circuit 50 configured to detect, amplify, filter and tune the electromagnetic signals, and to transmit signals in response, for controlling devices and operations 51 associated with the metal tubular 42.

The receiver-control circuit 50 can also be configured to emit signals for reception by the transmitter device 48, such that bi-directional data transfer through the non magnetic metal section 44 can be achieved. In this case the transmitter device 48 can be configured to transmit data to another location, such as a surface control panel, or to store data for subsequent retrieval.

The devices and operations 51 of the signal transmission system 40 are schematically represented by a block. Representative devices include perforating devices, packer devices, valves, sleeves, sensors, fluid analysis sensors, formation sensors and control devices. Representative operations include perforating operations, packer operations, valve operations, sleeve operations, sensing operations, monitoring operations, fluid analysis operations, formation operations and control operations.

For simplicity, the metal tubular 42 is shown as being located on only one side of the non magnetic metal section 44. However, in actual practice the non magnetic metal section 44 would likely be located at a mid point of the metal tubular 42, such that segments of the metal tubular 42 are on opposing ends of the non magnetic metal section 44. The metal tubular 42, and the non magnetic metal section 44, thus form a fluid tight conduit for transmitting fluids, such as oil and gas from a subterranean well.

In the illustrative embodiment, the metal tubular 42 comprises lengths of pipes or tubes attached to one another by joining members (not shown), such as collars, couplings, mating threads or weldments. The metal tubular 42 has a generally cylindrical configuration, and includes an inside portion 52, a sidewall portion 54, and an outside portion 56. In addition, the metal tubular 42 includes a female pipe thread 58 configured to threadably engage a male pipe thread 60 on the non magnetic metal section 44. Further, the non magnetic metal section 44 includes a female pipe thread 62, and the metal tubular 42 includes a segment (not shown) threadably attached to the female pipe thread 62.

Referring to FIGS. 3A–3F, the non magnetic metal section 44 is illustrated in greater detail. In the illustrative embodiment, the non magnetic metal section 44 comprises a metal tubular segment, that is similar in size and shape to the metal tubular 42, but which is made of a non magnetic metal.

Figure 3A:
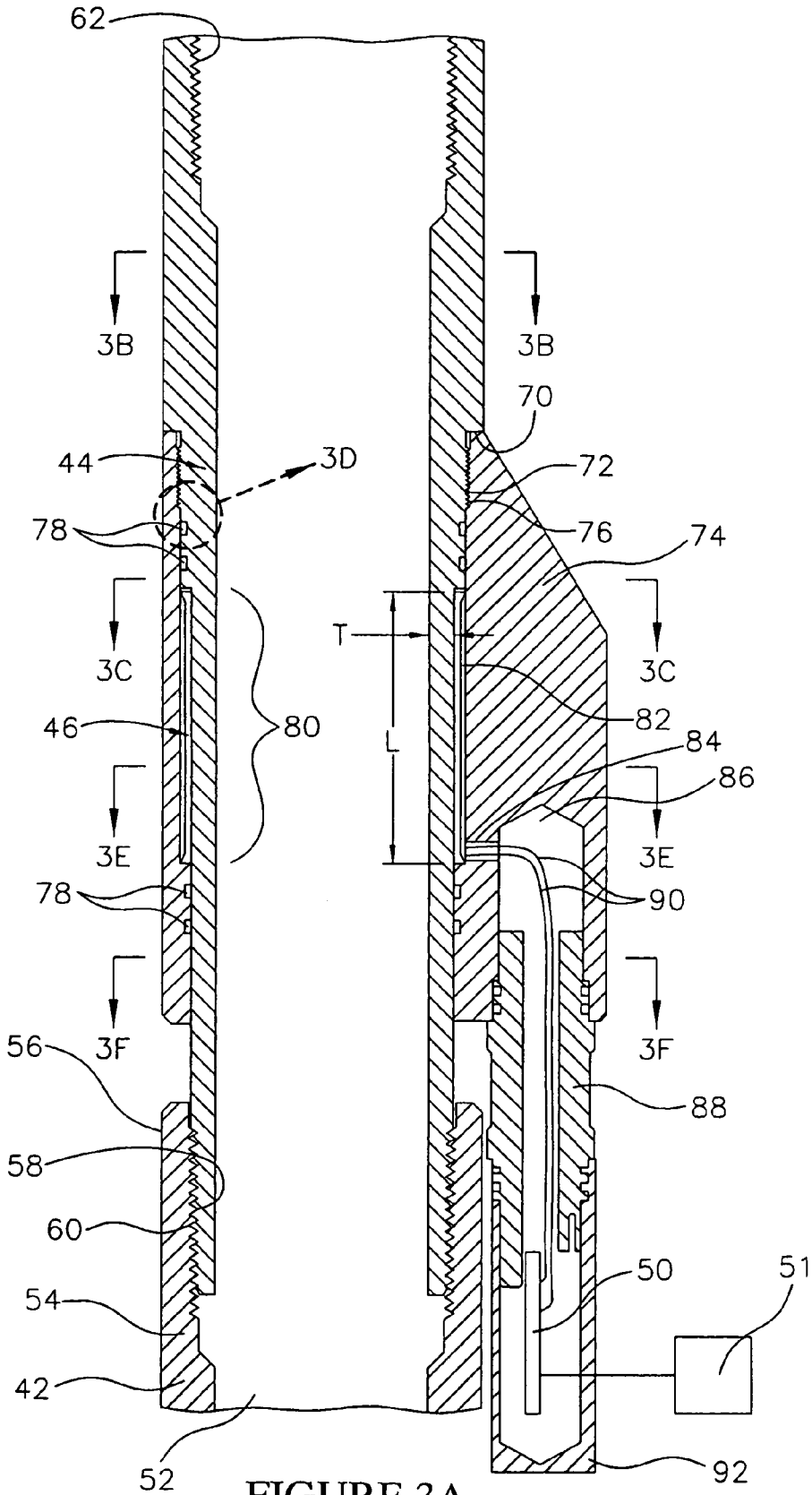
FIG. 3A is a schematic cross sectional view of a receiver-control component of the signal transmission system.
Figure 3B:
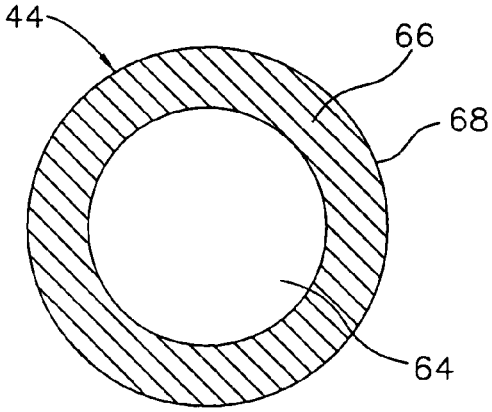
FIG. 3B is a cross sectional view taken along section line 3B—3B of FIG. 3A.

As shown in FIG. 3B, the non magnetic metal section 44 includes an inside portion 64, a sidewall portion 66, and an outside portion 68. The inside diameter of the inside portion 64, the thickness of the sidewall portion 66, and the outside diameter of the outside portion 68 vary along the length of the non magnetic metal section 44 to accommodate various features thereof. In the illustrative embodiment, the inside diameter of the inside portion 64, and the outside diameter of the outside portion 68, are approximately equal to the inside diameter and the outside diameter of the metal tubular 42.

In accordance with the invention, the material, treatment, alloying and geometry of the non magnetic metal section 44 are selected to optimize signal transmission through the non magnetic metal section 44. As used herein the term "signal transmission through the non magnetic metal section 44" means the electromagnetic signals are electrically conducted through the sidewall 66 of the non magnetic metal section 44. In this regard, the non magnetic metal section 44 is selected to have a high electrical conductivity such that the electromagnetic signals are efficiently conducted through the sidewall 66 without a substantial loss of power.

In the illustrative embodiment, the non magnetic metal section 44 comprises a non magnetic stainless steel. One suitable stainless steel is "Alloy 15-15LC", which comprises a nitrogen strengthened austenitic stainless steel available from Carpenter Technology Corporation of Reading, Pa. This stainless steel has a strength which meets or exceeds that of the metal tubular 42, such that the strength of the metal tubular 42, or a tubing string formed by the metal tubular 42, is not compromised. Other suitable alloys for the non magnetic metal section 44 include various "Inconel" alloys (Inc 600, 625, 725, 825, 925) available from Inco Alloys International LTD., of Canada, and "Hastelloy" alloys (C-276, G22) available from Haynes International, Inc. of Kokomo, Ind.

Also in the illustrative embodiment, the non magnetic metal section 44 includes a segment 80 proximate to the antenna 46 having a thickness T and an outside diameter OD. The thickness T, and the outside diameter OD of the segment 80 (along with the length L of the antenna 46), are selected to optimize signal transmission from the transmitter device 48 to the antenna 46. A representative range for the thickness T can be from about 5 mm to 10 mm. A representative range for the outside diameter OD can be from about 5 cm to 40 cm depending on tubing, casing and bore hole sizes.

Figure 3C:
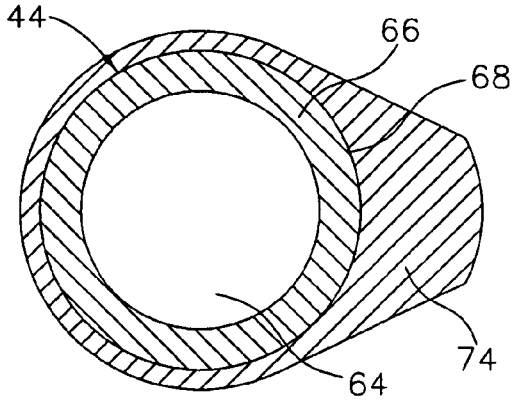
FIG. 3C is a cross sectional view taken along section line 3C—3C of FIG. 3A.

As also shown in FIG. 3C, the non magnetic metal section 44 includes a circumferential flat 70, and male threads 72 on the outside portion 68 thereof. The circumferential flat 70 and the male threads 72, are configured for mounting a y-block member 74, which is configured to house and seal the antenna 46 and the receiver-control circuit 50. The y-block member 74 includes female threads 76, configured to threadably engage the male threads 72 on the non magnetic metal section 44.

Figure 3D:
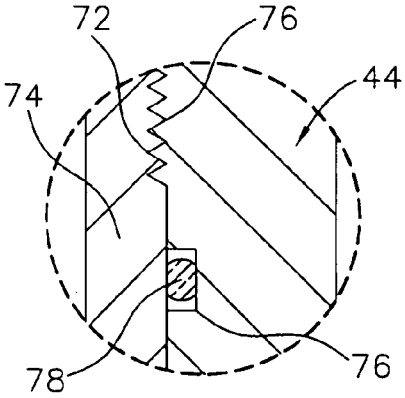
FIG. 3D is an enlarged view taken along line 3D of FIG. 3A.

As shown in FIG. 3C, the y-block member 74 has a generally asymmetrical Y shape with a variable thickness. As shown in FIG. 3D, the non magnetic metal section 44 also includes pairs of grooves 77 and sealing members 78, such as o-rings, which function to seal one end of the antenna 46 from the outside. As shown in FIG. 3A, other pairs of sealing members 78 on the Y-block member 74 are located proximate to an opposing end of the antenna 46, such that the antenna 46 is sealed on both ends.

The y-block member 74 can be formed of the same non magnetic material as the non magnetic metal section 44. Alternately, the y-block member 74 can be formed of a different magnetic or non magnetic material. Suitable materials for the y-block member 74 include steel and stainless steel.

Figure 3E:
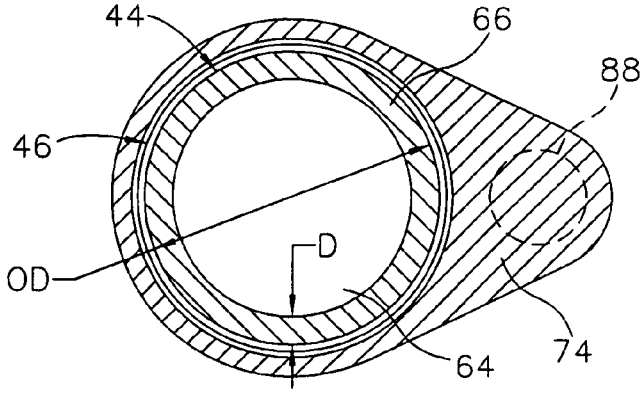
FIG. 3E is a cross sectional view taken along section line 3E—3E of FIG. 3A.
Figure 3F:
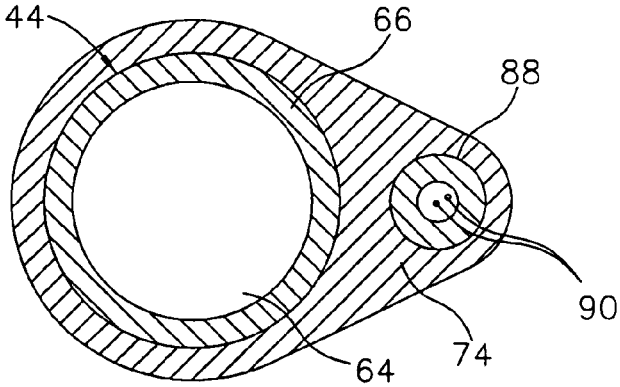
FIG. 3F is a cross sectional view taken along section line 3F—3F of FIG. 3A.

As shown in FIG. 3E, the y-block member 74 is shaped to form a sealed space 82 wherein the antenna 46 is located. As shown in FIG. 3A, the y-block member 74 includes an opening 84 to the sealed space 82. In addition, the y-block member 74 includes a threaded counterbore 86, and a threaded nipple 88 threadably attached to the counterbore 86. Wires 90 extend through the opening 84, through the counterbore 86 and through the threaded nipple 88. In addition, the wires 90 are electrically connected to the antenna 46 and to the receiver-control circuit 50. The y-block member 74 also includes a cap member 92, which along with the threaded nipple 88, is configured to house and seal the receiver-control circuit 50.

Figure 4A:
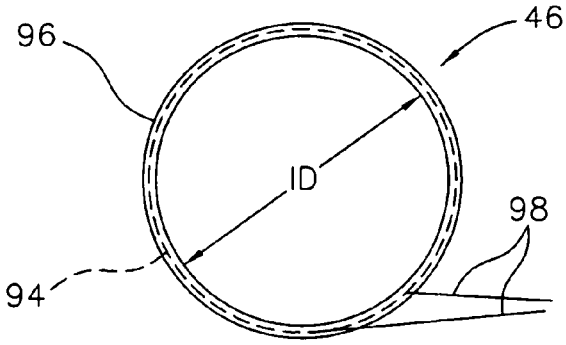
FIG. 4A is a schematic plan view of an antenna component of the signal transmission system.
Figure 4B:
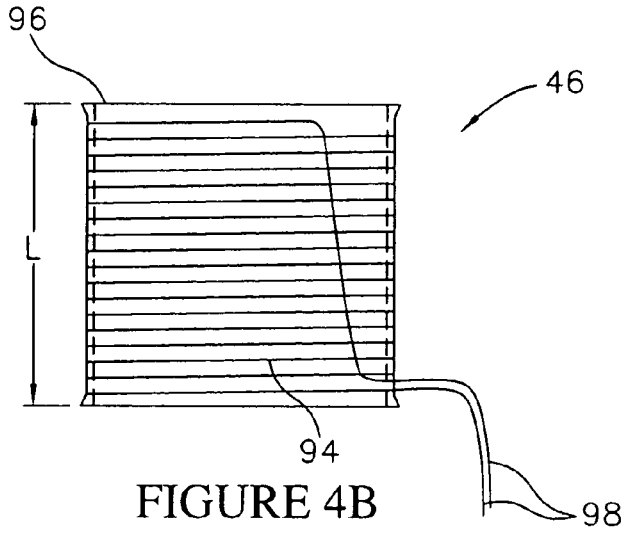
FIG. 4B is a schematic elevation view of the antenna component.

Referring to FIGS. 4A and 4B, the antenna 46 is shown separately. The antenna 46 includes a wire coil 94 wrapped around a non conductive sleeve member 96. The wire coil 94 terminates in wire ends 98, which are placed in electrical communication with the wires 90 and the receiver-control circuit 50 (FIG. 2). The antenna 46 is configured to receive (or detect) electromagnetic signals emitted by the transmitter device 48, or secondary fields associated with the electromagnetic signals. In addition, the length L of the wire coil 94 is selected to optimize reception of the electromagnetic signals from the transmitter device 48. In particular the length L is optimized based on data transmission speed, volume of data, and relative velocity of the transmitter device 48 relative to the antenna 46. A representative range for the length L can be from about 1 mm to 30 mm. In the case of bi directional data transfer, the antenna 46 can be configured to transmit electromagnetic signals from the receiver-control circuit 50 to the transmitter device 48.

The sleeve member 96 of the antenna 46 comprises a non conductive material, such as paper, plastic, fiberglass or a composite material. In addition, the sleeve member 96 has an inside diameter ID which is approximately equal to, or slightly larger than, the outside diameter OD (FIG. 3E) of the segment 80 of the non magnetic metal section 44.

Figure 5:
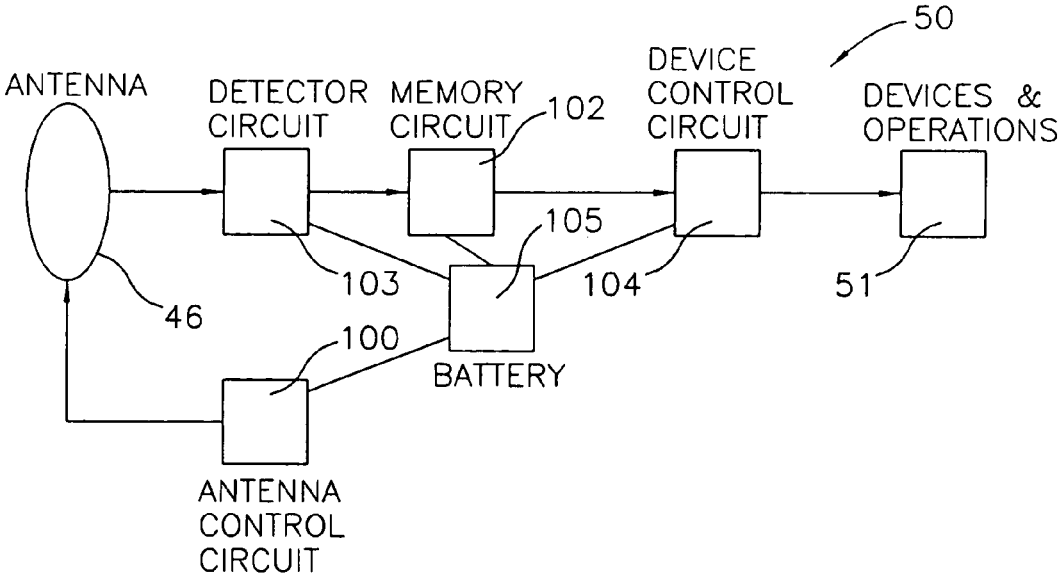
FIG. 5 is an electrical schematic of a receiver-control circuit component of the signal transmission system.

Referring to FIG. 5, elements of the receiver-control circuit 50 are shown in an electrical schematic. The receiver-control circuit 50 detects, amplifies, filters and decodes electromagnetic signals received (or detected) by the antenna 46. The receiver-control circuit 50 includes an antenna control circuit 100, and a detector circuit 103, both of which are in electrical communication with the antenna 46. The detector circuit 103 is configured to detect and decode the electromagnetic signals transmitted by the transmitter device 48 through segment 80 of the non magnetic metal section 44 to the antenna 46. The electromagnetic signals, although minute, can be directly radiated through the non magnetic section 44 and detected by the antenna 46 and the detector circuit 103. Alternately, the electromagnetic signals can produce a secondary field on the outside of the non magnetic section 44 due to the secondary effect of reverse currents. The detector circuit 103 and the antenna 46 can also be configured to detect such a secondary field.

The receiver-control circuit 50 also includes a processing-memory circuit 102 configured to process the electromagnetic signals in accordance with programmed information, or remote contemporaneous commands from an outside device (not shown). The receiver-control circuit 50 also includes a device control circuit 104 configured to control the devices and operations 51 responsive to the signals and programmed information. The receiver-control circuit 50 also includes a battery 105 or other power source, and can include electronic devices such as resistors, capacitors, and diodes arranged and interconnected using techniques that are known in the art.

In addition, the receiver-control circuit 50 can range from discrete components to a highly integrated system on a chip type architecture. As such, the design can consist of many discrete components to a highly integrated design involving software with digital signal processors and programmable logic. In the illustrative embodiment, the overall function of the receiver-control circuit 50 is to decode the electromagnetic signals and extract the binary information therefrom. However, the receiver-control circuit 50 can also be configured to generate electromagnetic signals from devices such as sensors. In this case the receiver-control circuit 50 can be configured to transmit signals to the transmitter device 48 or to another device, such as a control panel.

Figure 6A:
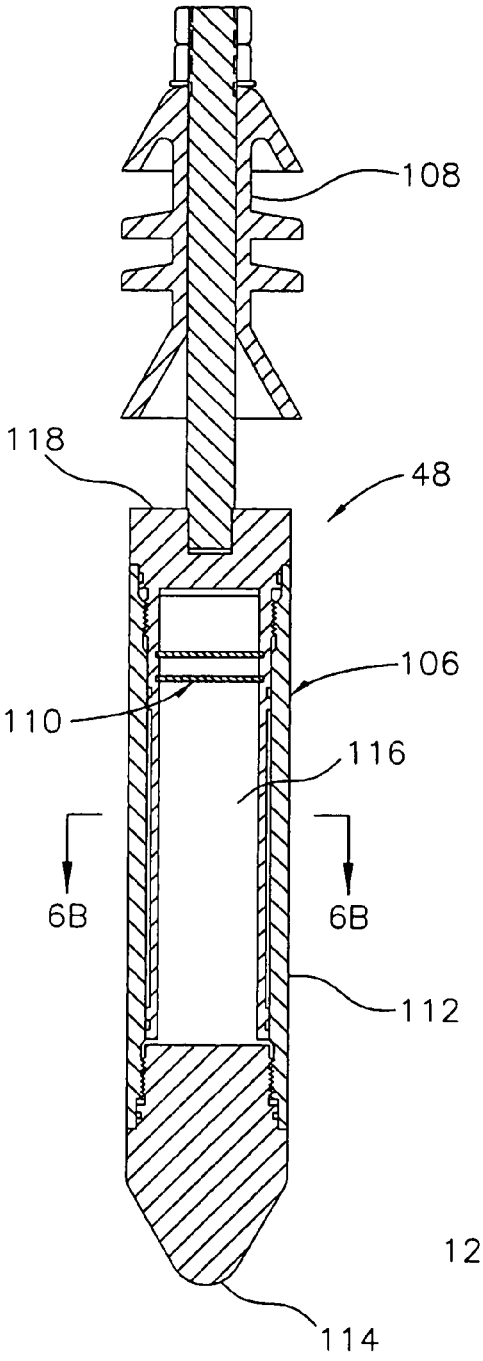
FIG. 6A is a schematic cross sectional view of a transmitter component of the signal transmission system.
Figure 6B:
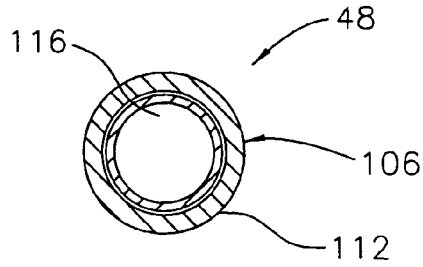
FIG. 6B is a cross sectional view taken along section line 6B—6B of FIG. 6A.

Referring to FIGS. 6A and 6B, the transmitter device 48 is shown separately. The transmitter device 48 includes a housing 106, and a transmitter circuit 110 mounted within the housing 106. The housing 106 includes a generally cylindrical body 112 having a sealed inner chamber 116 wherein the transmitter circuit 110 is mounted. The housing 106 also includes a generally conically shaped nose section 114, which threadably attaches to the body 112. In addition, the housing 106 includes a base section 118 which threadably attaches to the body 112. Suitable materials for the housing include fiberglass composite, ceramic, and non-conductive RF and magnetic field permeable materials.

The housing 106 also includes a wire line pig 108 attached to the base section 118. The wire line pig 108 allows the transmitter device 48 to be attached to a wire line (not shown), or a slick line (not shown), and moved through the metal tubular 42, and through the non magnetic metal section 44 proximate to the antenna 46. In addition, the wire line pig 108, and associated wire line (not shown), can be configured to conduct signals from the transmitter device 48 to another location, such as a surface control panel.

The wire line pig 108 can be in the form of a wireline fish neck, a wire line latching device, or a pump down pig. In addition, the wire line pig 108 can be used as a parachute to slow the drop of the transmitter device 48 (as shown in FIG. 2), or alternately can be reversed and the cup shape at one end used to pump the transmitter device 48 into a horizontal well bore. Rather than the wire line pig 108, the transmitter device 48 can be configured for movement through the metal tubular 42 and the non magnetic metal section 44 using any suitable propulsion mechanism such as pumping, gravity, robots, motors, or parachutes.

Figure 6C:
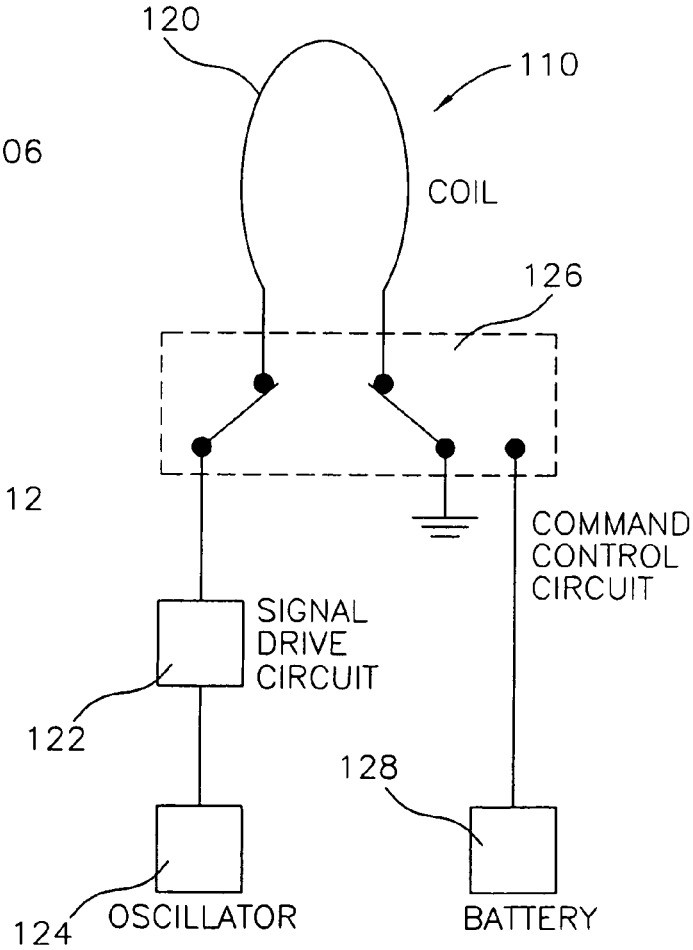
FIG. 6C is an electrical schematic of a transmitter circuit of the signal transmission system.

Referring to FIG. 6C, the transmitter circuit 110 is shown in an electrical schematic diagram. The transmitter circuit 110 includes a transmitter coil-capacitor 120 in electrical communication with a signal drive circuit 122, and with an oscillator 124 which is configured to modulate the electromagnetic signals. The transmitter circuit 110 also includes a command control circuit 126 configured to control signal transmission to the transmitter coil-capacitor 120. The transmitter circuit 110 also includes a battery 128 (or other power source) configured to power the components of the transmitter circuit 110.

The transmitter circuit 110 can also include electronic devices (not shown) such as resistors, capacitors and diodes arranged and interconnected using techniques that are known in the art. Further, the transmitter circuit 110 can include electronic devices, such as memory chips, configured to store data for subsequent retrieval. As another alternative, the transmitter circuit 110 can include electronic devices configured to transmit data to a remote location, such as a surface control panel.

Although any type of electromagnetic signals can be employed, in the illustrative embodiment the electromagnetic signals are modulated signals. As such, any suitable modulation format can be used to transmit a series of binary information representative of commands. Representative modulation formats include PSK (phase shift keying), FSK (frequency shift keying), ASK (amplitude shift keying), QPSK (quadrature phase shift keying), QAM (quadrature amplitude modulation), and others as well, such as spread spectrum techniques. In addition, any modulation technique using various combinations of modulating phase frequency or amplitude can be used to transmit a binary data sequence or other information. Further, even the presence of a non-modulated specific signal or frequency could be used to trigger a command or a device. In this case no modulation is necessary, only the presence or absence of a specific signaling means or signal pattern.

For practicing the method of the invention, the tubular 42 is provided with the non magnetic metal section 44 having the antenna 46 and the receiver-control circuit 50 configured as previously described. The transmitter device 48 is also provided as previously described, and is moved though the tubular 42 by a suitable propulsion mechanism, such as a wire line or a slick line. During movement through the tubular 42, the transmitter device 48 can continuously transmit electromagnetic signals. As the transmitter device 48 approaches and moves through the non magnetic metal section 44, the electromagnetic signals radiate through the non magnetic metal section 44, and are detected by the antenna 46 and the detector circuit 103 of the receiver-control circuit 50. Alternately, the electromagnetic signals can cause a secondary field on the outside of the non magnetic metal section 44, which can be detected by the antenna 46 and the detector circuit 103 of the receiver-control circuit 50. The receiver-control circuit 50 then amplifies, filters and tunes the electromagnetic signals, and transmits appropriate control signals to the devices and operations 51. Alternately for bi directional data transfer the receiver-control circuit 50 can be configured to transmit data back to the transmitter device 48, or to another element such as a control panel.

Figure 7A:
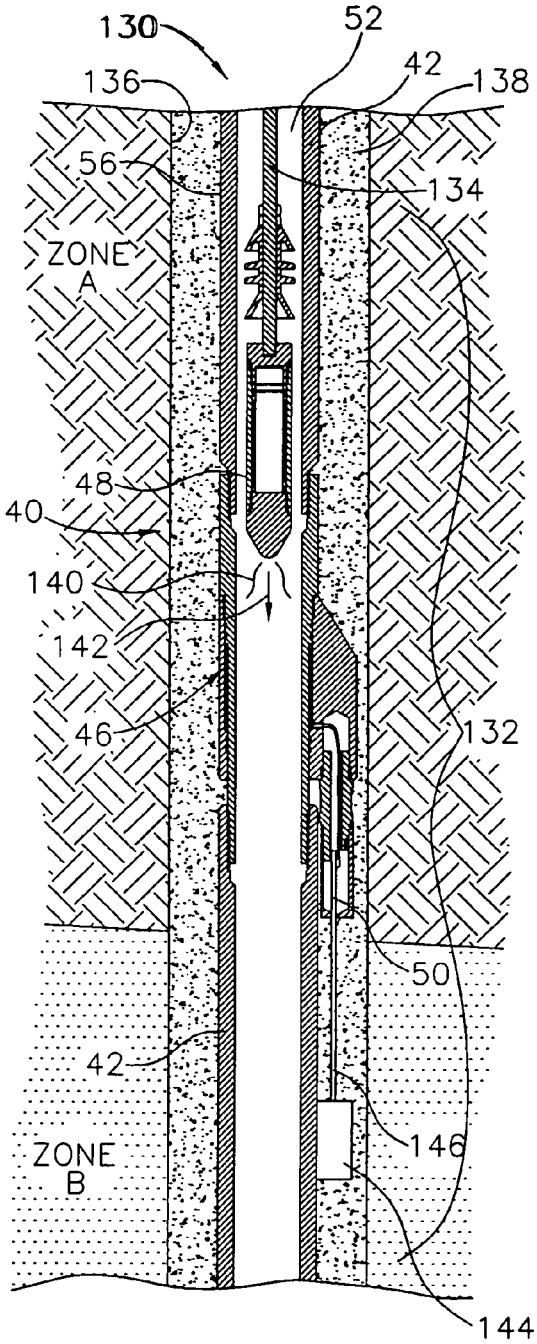
FIGS. 7A and 7B are schematic cross sectional views of a perforating system in a subterranean well which incorporates the signal transmission system.
Figure 7B:
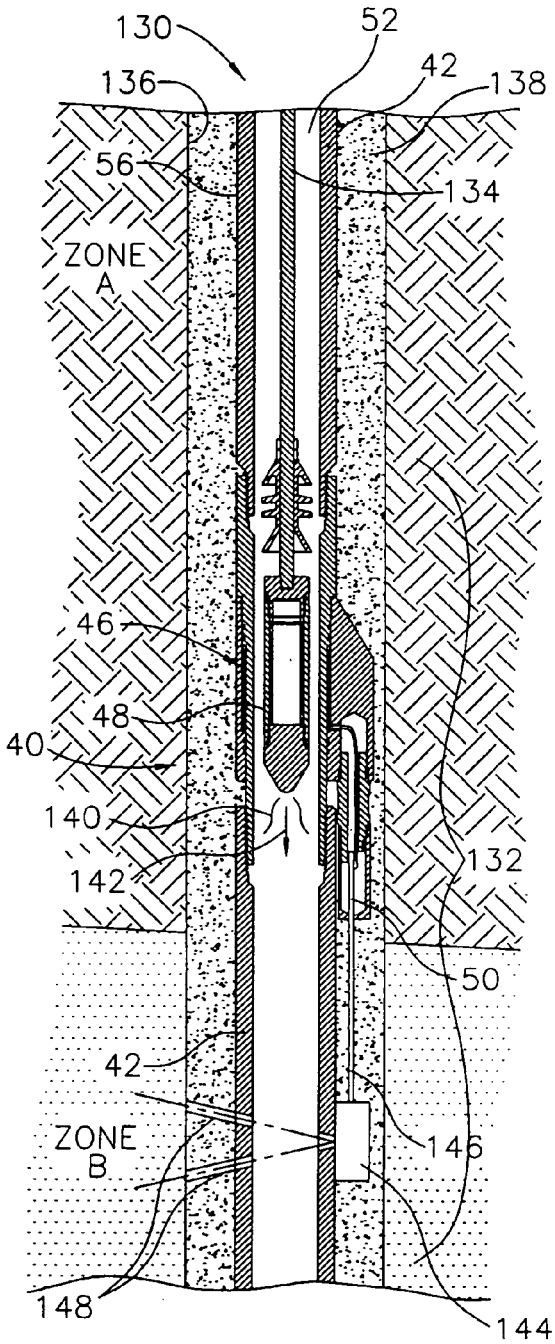

Referring to FIGS. 7A and 7B, a perforating system 132 which incorporates the signal transmission system 40, is illustrated in a subterranean well 130, such as an oil and gas well. The well 130 extends from an earthen surface (not shown) through different geological formations within the earth, such as geological Zone A and geological Zone B. The well 130 includes the metal tubular 42 having the inside portion 52 configured as a fluid tight conduit for transmitting fluids into and out of the well 130. The well 130 also includes a well bore 136, and concrete 138 in the well bore 136 surrounding the outer portion 56 of the metal tubular 42.

The signal transmission system 40 is located at a middle portion of the metal tubular 42, and within Zone A, substantially as previously described. The perforating system 132 also includes a perforating device 144 in Zone B, configured to perforate the metal tubular 42 and the concrete 138, to establish fluid communication between Zone B and the inside portion 52 of the metal tubular 42. A control conduit 146 establishes signal communication between the receiver-control circuit 50 of the system 40 and the perforating device 144. In addition, the exterior of the system 40 and the perforating device 144 are embedded in the concrete 138.

As shown in FIG. 7A, the transmitter device 48 of the system 40 is moved through the metal tubular 42 by a wire line 134 (or a slick line), as indicated by directional arrow 142. As the transmitter device 48 moves through the metal tubular 42 electromagnetic signals 140 are continuously (or intermittingly) emitted, substantially as previously described. As shown in FIG. 7B, when the transmitter device 48 comes into proximity to the antenna 46, the electromagnetic signals 140 are detected by the antenna 46. Upon detection of the electromagnetic signals 140, the receiver-control circuit 50 amplifies, filters and tunes the signals and sends control signals to actuate the perforating device 144. Actuation of the perforating device 144 then forms perforations 148 in the metal tubular 42 and in the concrete 138. In this embodiment the perforating system 132 and the signal transmission system 40 can be used to improve production from the well 130.

Figure 8A:
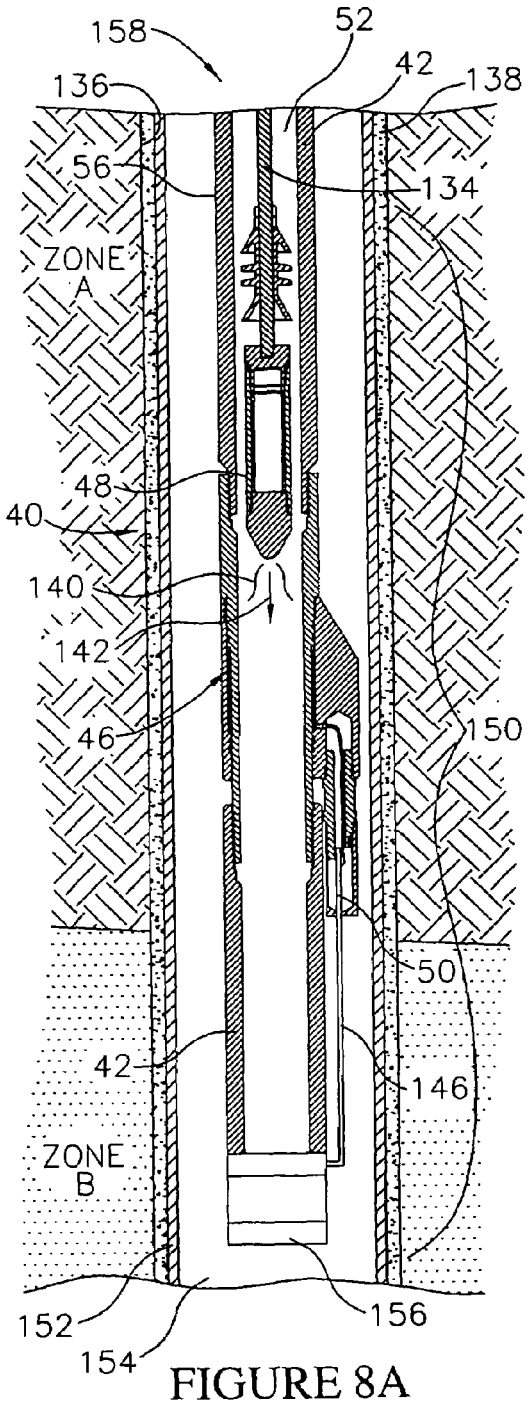
FIGS. 8A and 8B are schematic cross sectional views of a packer system in a subterranean well which incorporates the signal transmission system.
Figure 8B:
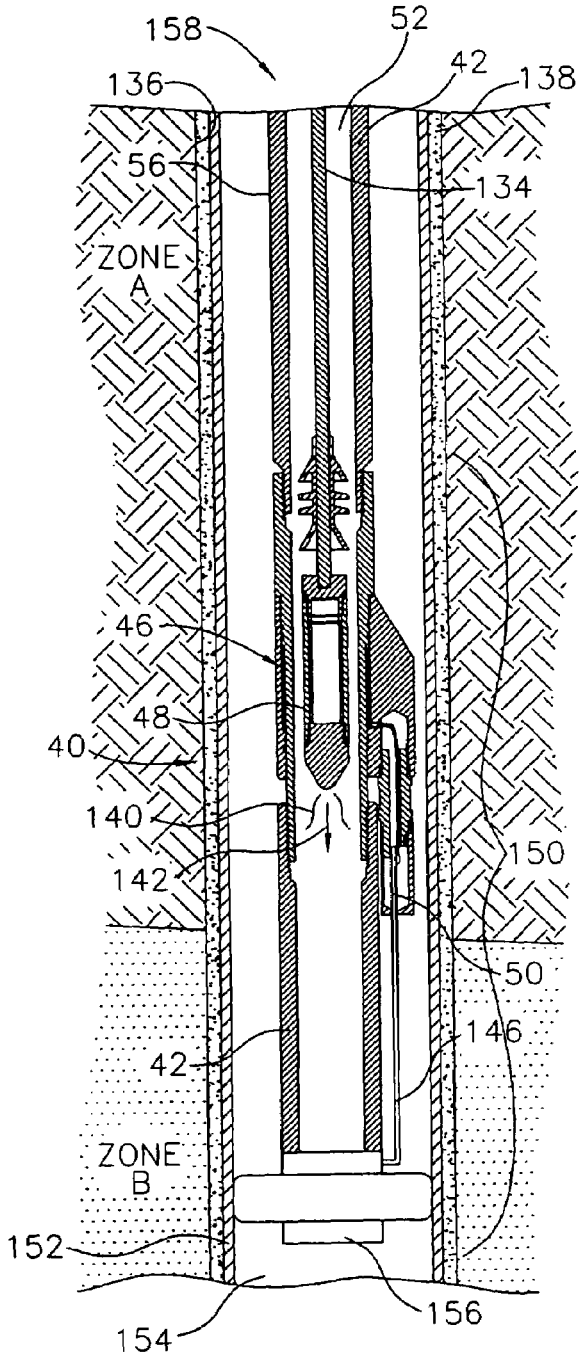

Referring to FIGS. 8A and 8B, a packer system 150 which incorporates the signal transmission system 40 is illustrated in a subterranean well 158, such as an oil and gas well. The well 158 is substantially similar to the previously described well 130. However, the well 158 includes a well casing 152 embedded in concrete 138, and the metal tubular 42 is located within an inside diameter 154 of the casing 152. The packer system 150 also includes a packer device 156 connected to the metal tubular 42. The packer device 156 is configured for actuation by the receiver-control circuit 50 from the uninflated condition of FIG. 8A to the inflated condition of FIG. 8B. In the inflated condition of FIG. 8B the packer device 156 seals the inside diameter 154 of the casing 152 but allows fluid flow through the metal tubular 42. The packer device 156 is controlled by the signal transmission system 40 substantially as previously described for the perforating system 132 (FIGS. 7A–7B).

Figure 9A:
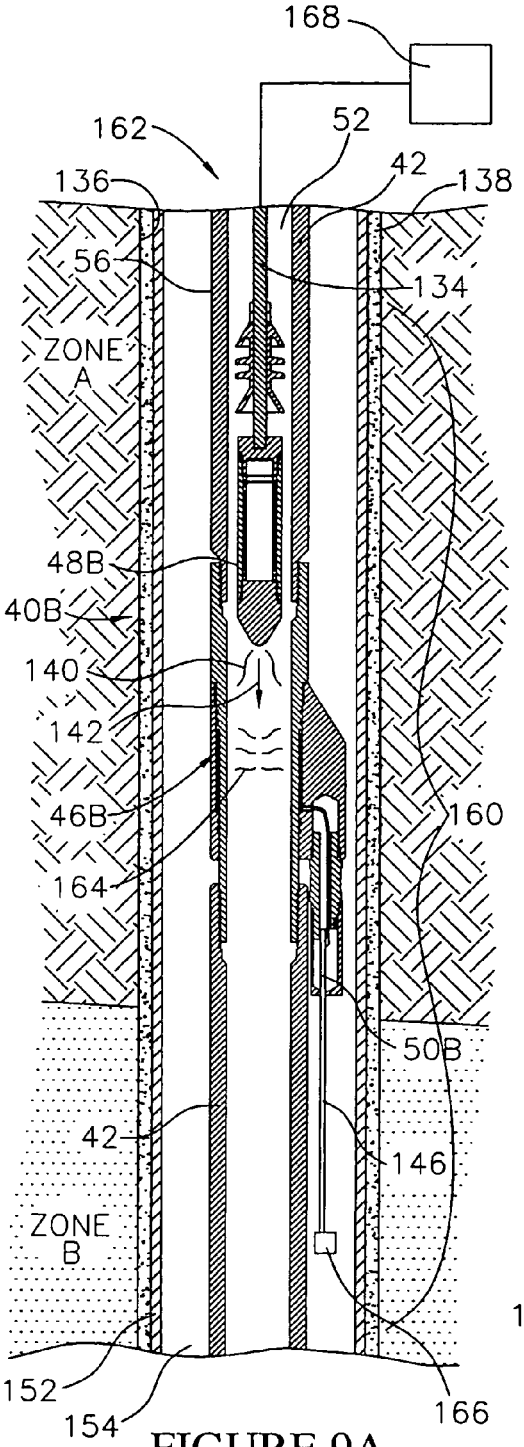
FIGS. 9A and 9B are schematic cross sectional view of a sensing and monitoring system in a subterranean well which incorporates the signal transmission system.
Figure 9B:
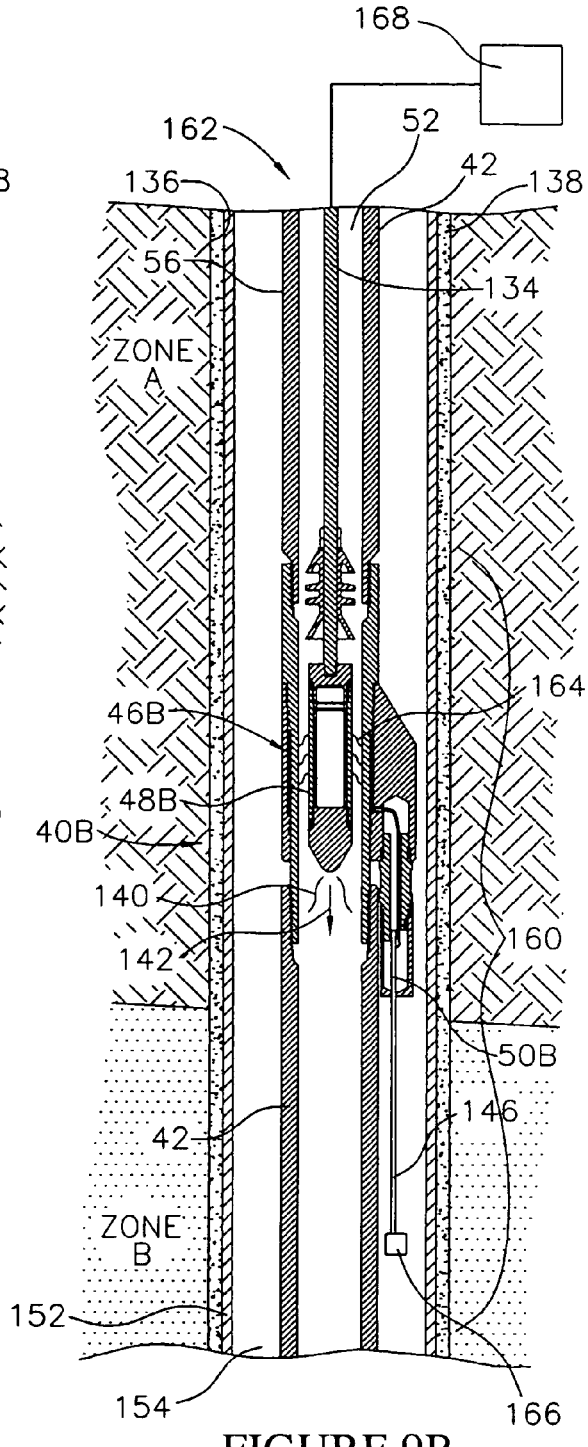

Referring to FIGS. 9A and 9B, a sensing and monitoring system 160 which incorporates a bi-directional signal transmission system 40B is illustrated in a subterranean well 162, such as an oil and gas well. The well 162 is substantially similar to the previously described well 158 (FIG. 8A). The sensing and monitoring system 160 includes a sensing device 166 within the inner diameter 154 of the casing 152. The sensing device 166 is configured to detect some parameter within the casing such as temperature, pressure, fluid flow rate, or chemical content. In addition, a receiver-control circuit 50B is in electrical communication with the sensing device 166 and is configured to emit electromagnetic signals 164 through an antenna 46B, which are representative of the parameters detected by the sensing device 166.

The sensing and monitoring system 160 also includes a transmitter device 50B configured to emit electromagnetic signals 140 to the antenna 46B, substantially as previously described. In addition, the transmitter device 50B is configured to receive the electromagnetic signals 164 generated by the receiver-control circuit 50B and transmitted through the antenna 46B. Further, the transmitter device 50B is in electrical communication with a control panel 168 at the surface which is configured to display or store data detected by the sensing device 166. Alternately, the transmitter device 50B can be configured to store this data for subsequent retrieval.

Thus the invention provides a method and a system for transmitting signals through a metal tubular. While the invention has been described with reference to certain preferred embodiments, as will be apparent to those skilled in the art, certain changes and modifications can be made without departing from the scope of the invention as defined by the following claims.

What is claimed is:

1. A method for transmitting signals through a tubular comprising:

transmitting electromagnetic signals through a non-magnetic metal section in the tubular; and selecting a material, a geometry, a treatment and an alloying of the non magnetic section to optimize the transmitting step.

2. The method of claim 1 wherein the tubular comprises a metal.

3. The method of claim 1 wherein the tubular is contained within a subterranean well.

4. The method of claim 1 further comprising detecting the electromagnetic signals during the transmitting step.

5. The method of claim 1 further comprising detecting a field produced by the electromagnetic signals during the transmitting step.

6. The method of claim 1 further comprising controlling or monitoring a device or an operation associated with the tubular responsive to the transmitting step.

7. The method of claim 1 wherein the non magnetic metal section comprises a tubular segment having an inside, a sidewall and an outside.

8. The method of claim 1 wherein the non magnetic metal section comprises a stainless steel tubular segment.

9. The method of claim 1 wherein the electromagnetic signals comprise an element selected from the group consisting of radio frequency (rf) signals, electric field signals, electromagnetic field signals and magnetic field signals.

10. A method for transmitting signals in a metal tubular having a non magnetic metal tubular section comprising:

transmitting electromagnetic signals from an inside of the non magnetic metal tubular section, through a sidewall of the non magnetic metal tubular section, to an antenna positioned on an outside of the non magnetic metal tubular section;

the antenna detecting the electromagnetic signals, or a secondary field associated with the electromagnetic signals.

11. The method of claim 10 further comprising controlling or monitoring a device or an operation associated with the metal tubular responsive to the detecting step.

12. The method of claim 10 further comprising transmitting electromagnetic signals from a sensing device associated with the metal tubular from the outside of the non magnetic metal tubular section, through the sidewall of the non magnetic tubular section.

13. The method of claim 10 wherein the non magnetic metal tubular section comprises austenitic stainless steel.

14. The method of claim 10 wherein the non magnetic metal tubular section comprises nitrogen strengthened austenitic stainless steel.

15. The method of claim 10 wherein the antenna comprises a wire coil mounted to the outside of the non magnetic metal tubular section.

16. The method of claim 10 wherein the signals comprise electromagnetic signals.

17. The method of claim 10 wherein the electromagnetic signals comprise a signal selected from the group consisting of radio frequency signals, electric field signals, electromagnetic field signals and magnetic field signals.

18. The method of claim 10 wherein the metal tubular is contained in a subterranean well.

19. The method of claim 18 wherein the method is used to improve production from the well.

20. A method for transmitting signals in a metal tubular having a non magnetic metal tubular section comprising:

moving a transmitter device configured to emit electromagnetic signals through the metal tubular and through the non magnetic metal tubular section;

emitting the electromagnetic signals during the moving step; and detecting the electromagnetic signals, or a secondary field associated with the electromagnetic signals, using an antenna positioned proximate to the non magnetic metal tubular section.

21. The method of claim 20 further comprising controlling or monitoring a device or an operation associated with the metal tubular responsive to the detecting step.

22. The method of claim 20 further comprising transmitting signals through the non magnetic metal tubular section during the detecting step.

23. The method of claim 20 further comprising monitoring a sensor responsive to the detecting step.

24. The method of claim 20 wherein the non magnetic metal tubular section includes a y-block and the antenna is sealed in the y-block.

25. The method of claim 20 wherein the electromagnetic signals comprise modulated electromagnetic signals in a format selected from the group consisting of PSK (phase shift keying), FSK (frequency shift keying), ASK (amplitude shift keying), QPSK (quadrature phase shift keying), QAM (quadrature amplitude modulation), and spread spectrum techniques.

26. The method of claim 20 wherein the moving step is performed using a wire line, a slick line, a parachute or a robot.

27. A signal transmission system comprising:

a metal tubular;

a non magnetic metal section on the metal tubular; and an antenna outside the tubular proximate to the non magnetic metal section configured to receive electromagnetic signals transmitted through the non magnetic metal section.

28. The system of claim 27 wherein the non magnetic metal section comprises a tubular member.

29. The system of claim 27 wherein the non magnetic metal section comprises a stainless steel tubular member.

30. The system of claim 27 further comprising a transmitter device inside the metal tubular configured to emit the electromagnetic signals.

31. The system of claim 27 wherein the non magnetic metal section has an outside diameter and the antenna comprises a coiled wire on the outside diameter.

32. The system of claim 27 further comprising a receiver-control circuit outside of the metal tubular in electrical communication with the antenna configured to control or monitor a device or operation associated with the metal tubular.

33. The system of claim 27 wherein the metal tubular is contained in a subterranean well.

34. A signal transmission system comprising:

a metal tubular having a non magnetic metal section;

a transmitter device configured to move through the metal tubular and the non magnetic metal section and to emit electromagnetic signals through the non magnetic metal section; and an antenna outside the non magnetic metal section configured to detect the electromagnetic signals or a secondary field associated with the electromagnetic signals.

35. The system of claim 34 wherein a material, a geometry, a treatment, and an alloying of the non magnetic metal section are selected to optimize signal transmission therethrough.

36. The system of claim 34 wherein the non magnetic metal section has a thickness T and the antenna has a length L selected to optimize signal transmission through the non magnetic metal section.

37. The system of claim 34 further comprising a control circuit outside of the metal tubular in signal communication with the antenna configured to control or monitor a device or operation associated with the metal tubular responsive to the electromagnetic signals.

38. The system of claim 34 further comprising a y-block on the non magnetic metal section configured to house and seal the antenna.

39. The system of claim 34 wherein the non magnetic metal section comprises stainless steel.

40. The system of claim 34 wherein the non magnetic metal section comprises nitrogen strengthened austenitic stainless steel.

41. A signal transmission system in a metal tubular comprising:

a transmitter device inside the metal tubular configured to emit electromagnetic signals;

a non magnetic metal tubular section on the metal tubular configured to transmit the electromagnetic signals;

an antenna outside the metal tubular proximate to the non magnetic metal tubular section configured to receive the electromagnetic signals or a secondary field associated with the electromagnetic signals; and a receiver-control circuit outside the metal tubular in electrical communication with the antenna configured to detect the electromagnetic signals or the secondary field, and to control or monitor a device or operation associated with the metal tubular.

42. The system of claim 41 wherein the device comprises a sensor device.

43. The system of claim 41 wherein the metal tubular comprises a component of an oil and gas well.

44. The system of claim 41 wherein the non magnetic metal tubular section comprises austenitic stainless steel.

45. The system of claim 41 wherein the non magnetic metal tubular section comprises nitrogen strengthened austenitic stainless steel.

46. The system of claim 41 wherein the electromagnetic signals comprise modulated electromagnetic signals selected from the group consisting of radio frequency (rf) signals, electric field signals, electromagnetic field signals and magnetic field signals.

47. A signal transmission system in a metal tubular comprising:

a non magnetic metal tubular section on the metal tubular having a sidewall;

an antenna proximate to the non magnetic metal tubular section;

a transmitter device inside the metal tubular configured to transmit electromagnetic signals through the sidewall of the non magnetic metal tubular section to the antenna; and a circuit in signal communication with the antenna configured to detect, amplify, filter and tune the electromagnetic signals, or a secondary field associated with the electromagnetic signals.

48. The system of claim 47 wherein the antenna comprises a generally cylindrical non conductive core mounted to an outside diameter of the non magnetic metal tubular section, and a metal wire wrapped around the core.

49. The system of claim 47 further comprising a y-block on the non magnetic metal tubular section configured to seal the antenna and house the circuit.

50. The system of claim 47 wherein the electromagnetic signals comprise modulated electromagnetic signals in a format selected from the group consisting of PSK (phase shift keying), FSK (frequency shift keying), ASK (amplitude shift keying), QPSK (quadrature phase shift keying), QAM (quadrature amplitude modulation), and spread spectrum techniques.

51. The system of claim 47 further comprising a device outside of the metal tubular in signal communication with the circuit, and wherein the circuit is configured to transmit control signals to the device.

52. The system of claim 47 further comprising a sensing device outside of the metal tubular in signal communication with the circuit configured to detect a parameter, and wherein the circuit is configured to transmit signals representative of the parameter through the non magnetic metal tubular section.

53. The system of claim 47 wherein the transmitter device includes a housing, a coil in the housing and an oscillator in signal communication with the coil.

54. A method for improving production in an oil and gas well having a metal tubular with a non magnetic metal section comprising:

moving a transmitter device through the metal tubular and the non magnetic metal section while emitting electromagnetic signals therefrom;

transmitting the electromagnetic signals through the non magnetic metal section;

detecting the electromagnetic signals transmitted through the non magnetic metal section; and controlling or monitoring a device or an operation associated with the well responsive to the detecting step.

55. The method of claim 54 wherein the detecting step is performed using an antenna outside of the non magnetic metal section configured to detect the electromagnetic signals or a secondary field associated with the electromagnetic signals.

56. The method of claim 54 wherein the non magnetic metal section comprises a stainless steel tubular segment.

57. The method of claim 54 wherein the device comprise an element selected from the group consisting of perforating devices, packer devices, valves, sleeves, sensors, fluid analysis sensors, formation sensors and control devices.

58. The method of claim 54 wherein the antenna is located in a first zone of the well and the device is located in a second zone of the well.

59. A method for transmitting signals in a metal tubular having a non magnetic metal tubular section comprising:

moving a transmitter device configured to emit electromagnetic signals through the metal tubular and through the non magnetic metal tubular section;

emitting the electromagnetic signals during the moving step;

detecting the electromagnetic signals, or a secondary field associated with the electromagnetic signals, using an antenna positioned proximate to the non magnetic metal tubular section; and detonating a perforating device responsive to the detecting step.

60. A method for transmitting signals in a metal tubular having a non magnetic metal tubular section comprising:

moving a transmitter device configured to emit electromagnetic signals through the metal tubular and through the non magnetic metal tubular section;

emitting the electromagnetic signals during the moving step;

detecting the electromagnetic signals, or a secondary field associated with the electromagnetic signals, using an antenna positioned proximate to the non magnetic metal tubular section; and actuating a packer device responsive to the detecting step.

61. A method for transmitting signals in a metal tubular contained in a subterranean well and having a non magnetic metal tubular section comprising:

moving a transmitter device configured to emit electromagnetic signals through the metal tubular and through the non magnetic metal tubular section;

emitting the electromagnetic signals during the moving step;

detecting the electromagnetic signals, or a secondary field associated with the electromagnetic signals, using an antenna positioned proximate to the non magnetic metal tubular section, said detecting step being used to improve production from the well.

62. A signal transmission system in a metal tubular comprising:

a transmitter device inside the metal tubular configured to emit electromagnetic signals;

a non magnetic metal tubular section on the metal tubular configured to transmit the electromagnetic signals;

a non magnetic metal tubular section on the metal tubular configured to transmit the electromagnetic signals;

an antenna outside the metal tubular proximate to the non magnetic metal tubular section configured to receive the electromagnetic signals or a secondary field associated with the electromagnetic signals; and a receiver-control circuit outside the metal tubular in electrical communication with the antenna configured to detect the electromagnetic signals or the secondary field, and to control or monitor a perforating device or operation associated with the metal tubular.

63. A signal transmission system in a metal tubular comprising:

a transmitter device inside the metal tubular configured to emit electromagnetic signals;

a non magnetic metal tubular section on the metal tubular configured to transmit the electromagnetic signals;

a non magnetic metal tubular section on the metal tubular configured to transmit the electromagnetic signals;

an antenna outside the metal tubular proximate to the non magnetic metal tubular section configured to receive the electromagnetic signals or a secondary field associated with the electromagnetic signals; and a receiver-control circuit outside the metal tubular in electrical communication with the antenna configured to detect the electromagnetic signals or the secondary field, and to control or monitor a packer device or operation associated with the metal tubular.

64. A method for transmitting signals in a subterranean well having a metal tubular with a non magnetic metal section comprising:

moving a transmitter device through the metal tubular and the non magnetic metal section while emitting electromagnetic signals therefrom; and controlling or monitoring a device or an operation associated with the well responsive to the detecting the electromagnetic signals that are transmitted through the non magnetic metal section.

* * * * *